US007182175B1

(12) United States Patent
Schmitt et al.

(10) Patent No.: US 7,182,175 B1
(45) Date of Patent: Feb. 27, 2007

(54) RETRACTABLE TELESCOPIC BOAT LADDER

(75) Inventors: Ronald T. Schmitt, Lancaster, PA (US); Albert H. Bender, Jr., Lebanon, PA (US)

(73) Assignee: G.G. Schmitt & Sons, Inc., Lancaster, PA (US)

( * ) Notice: Subject to any disclaimer, the term of this patent is extended or adjusted under 35 U.S.C. 154(b) by 252 days.

(21) Appl. No.: 10/918,801

(22) Filed: Aug. 16, 2004

(51) Int. Cl.
*B63B 17/00* (2006.01)

(52) U.S. Cl. ..... 182/88; 114/362

(58) Field of Classification Search ..... 182/88, 182/95, 127, 86; 114/362; 280/166
See application file for complete search history.

(56) References Cited

U.S. PATENT DOCUMENTS

| | | | | | |
|---|---|---|---|---|---|
| 2,642,217 | A * | 6/1953 | Jennings | 182/88 |
| 3,008,533 | A * | 11/1961 | Haberle | 182/88 |
| 4,733,752 | A | 3/1988 | Sklar | 182/86 |
| 4,811,817 | A | 3/1989 | Geary | 182/76 |
| D331,219 | S | 11/1992 | Barbour | D12/317 |
| 5,427,049 | A * | 6/1995 | Mardikian | 114/362 |
| 6,021,733 | A | 2/2000 | Jaramillo | 114/362 |
| 6,904,863 | B2 * | 6/2005 | Mardikian et al. | 114/362 |
| 7,025,174 | B1 * | 4/2006 | Hawley | 182/88 |

* cited by examiner

*Primary Examiner*—Alvin Chin-Shue
(74) *Attorney, Agent, or Firm*—Miller Law Group, PLLC

(57) ABSTRACT

A telescopic ladder apparatus can be deployed from a closed receptacle on the stern portion of a boat. The ladder is formed with telescopic side rails supporting transverse treads that can collapse into a stored position in which the treads are placed adjacent one another. The side rails are mounted to a slide mechanism that is mounted in the receptacle for sliding movement relative to the boat. The slide mechanism supports the side rails for a linear sliding movement to permit the deployment of the ladder externally of the receptacle to be telescopically extended toward the water. The side rails are pivotable downwardly to position the ladder into a generally vertical deployed position from the generally horizontal stored position. The receptacle housing the telescopic ladder and slide mechanism is opened for access to the ladder through a generally vertically oriented door that provides a clean aesthetic appearance for the boat.

11 Claims, 5 Drawing Sheets

Fig. 1
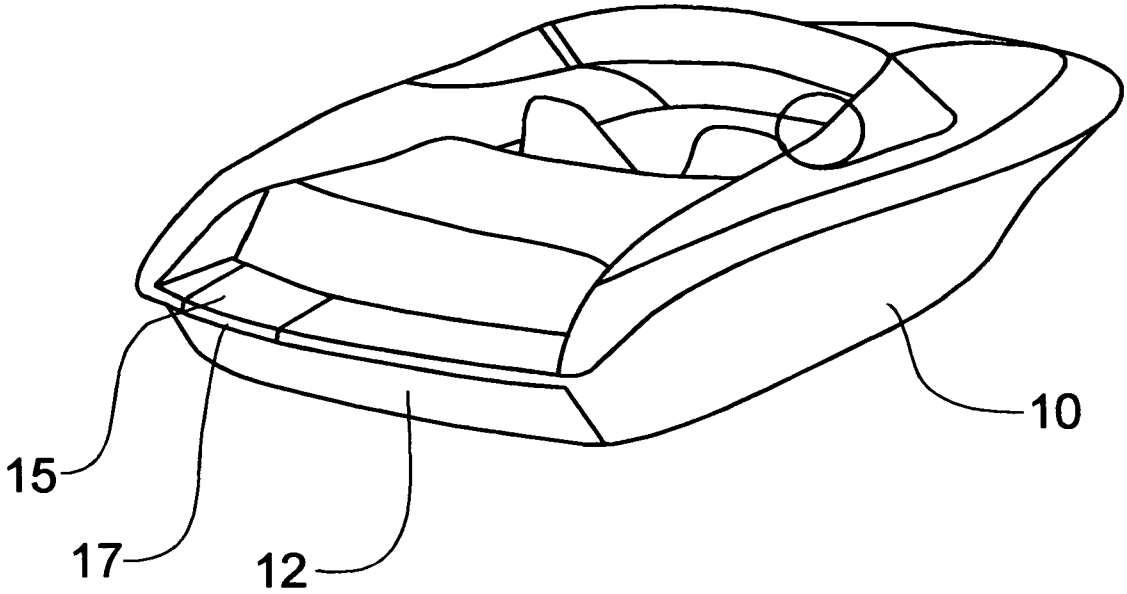
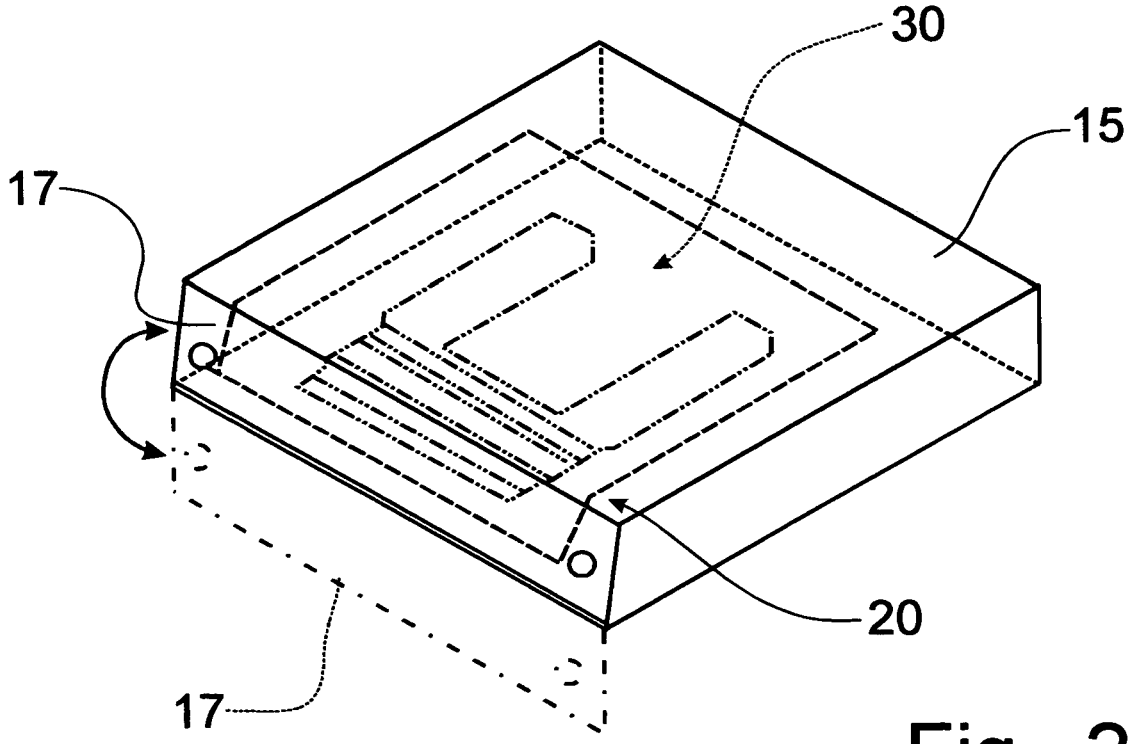
Fig. 2

Fig. 4
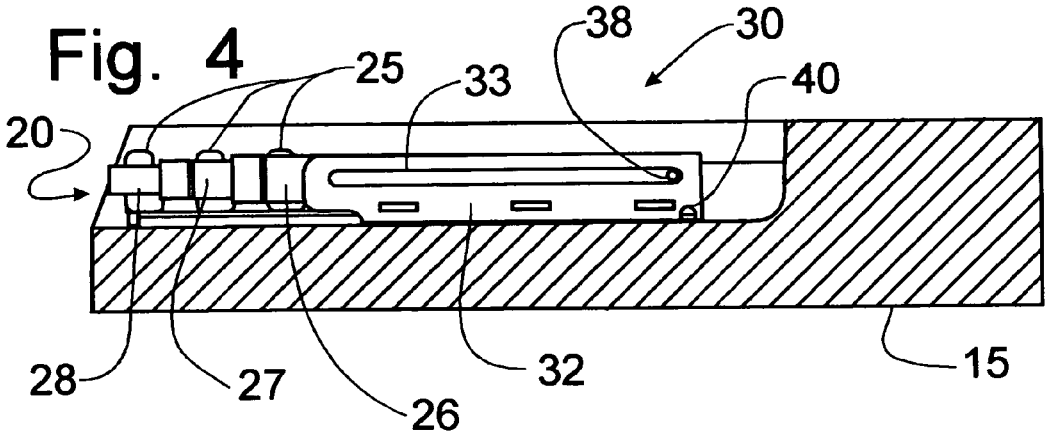
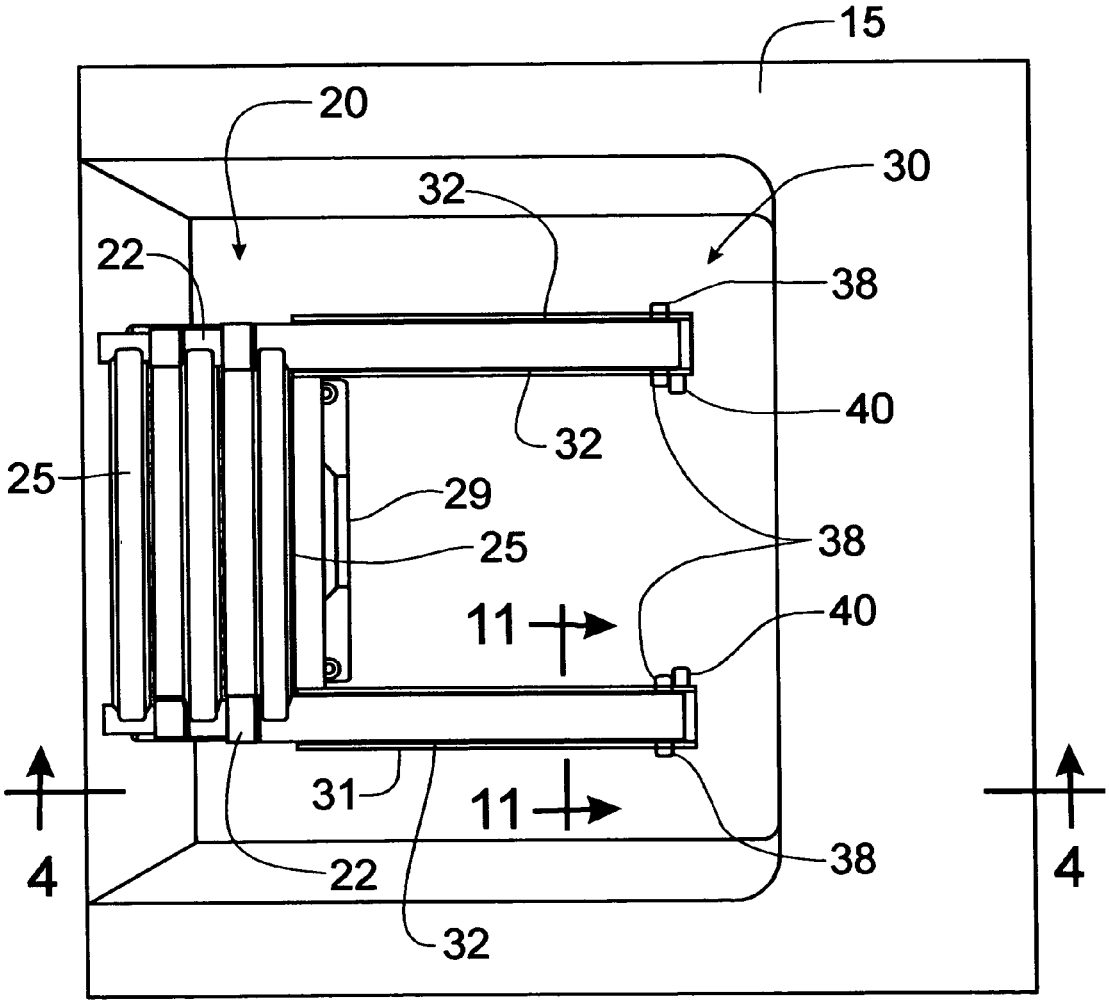
Fig. 3

Fig. 5
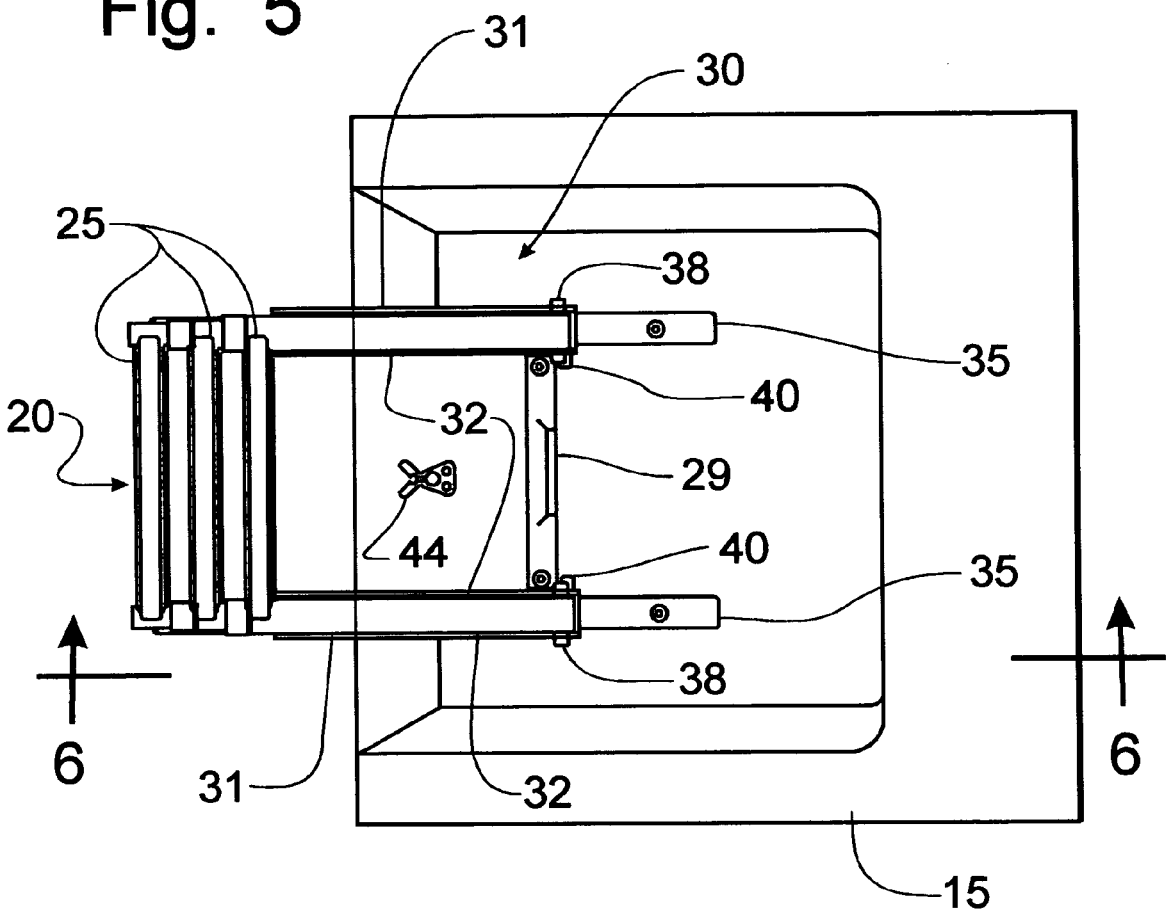
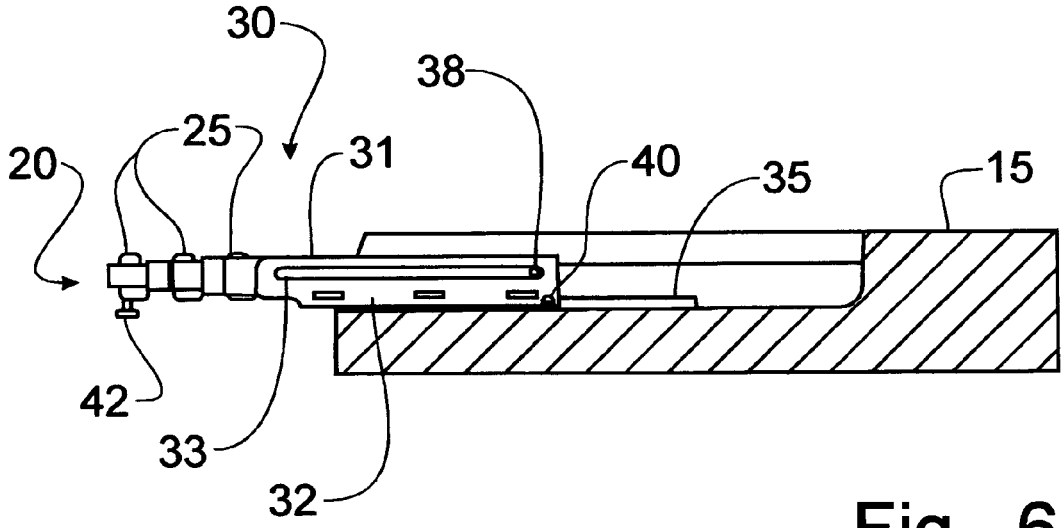
Fig. 6

Fig. 7
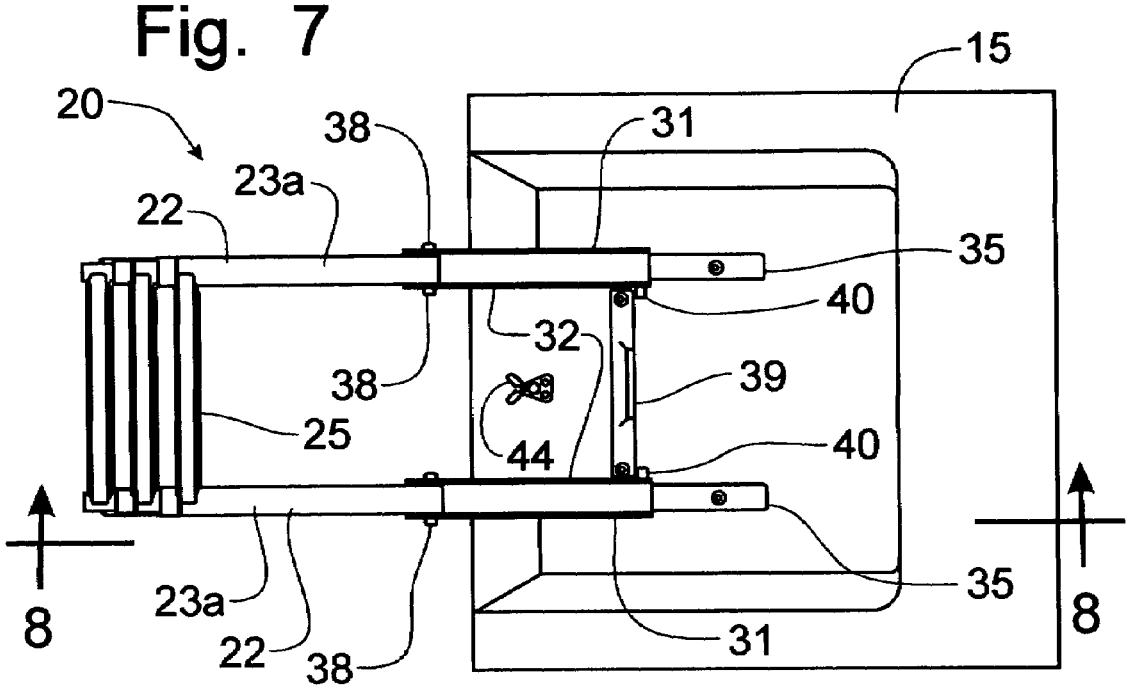
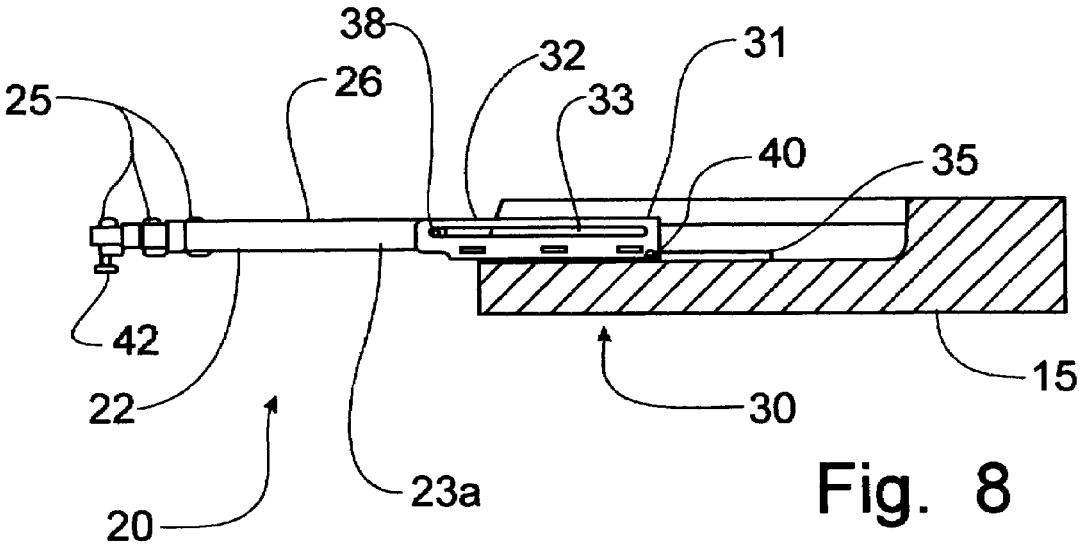
Fig. 8

Fig. 10
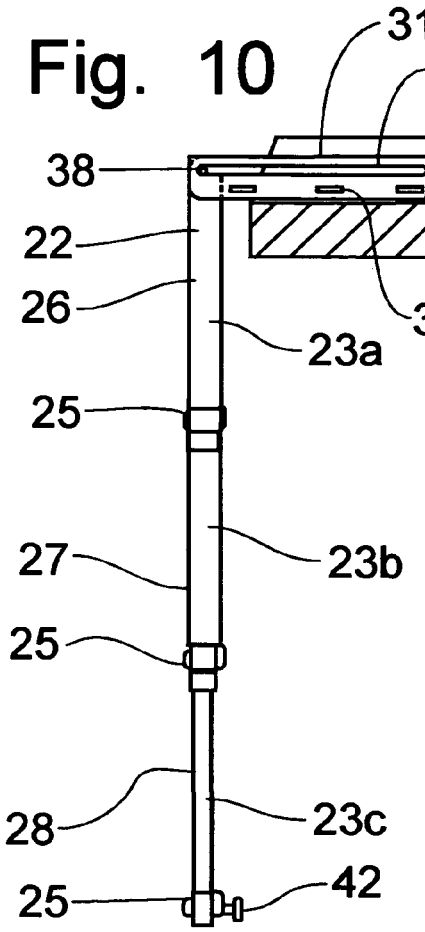
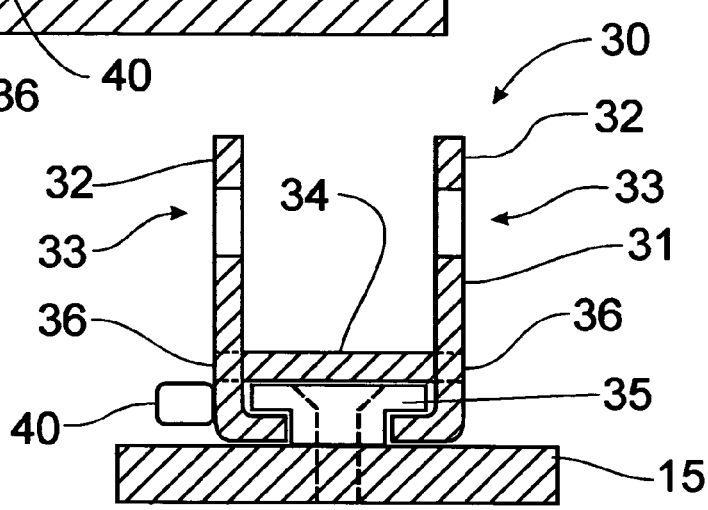
Fig. 11
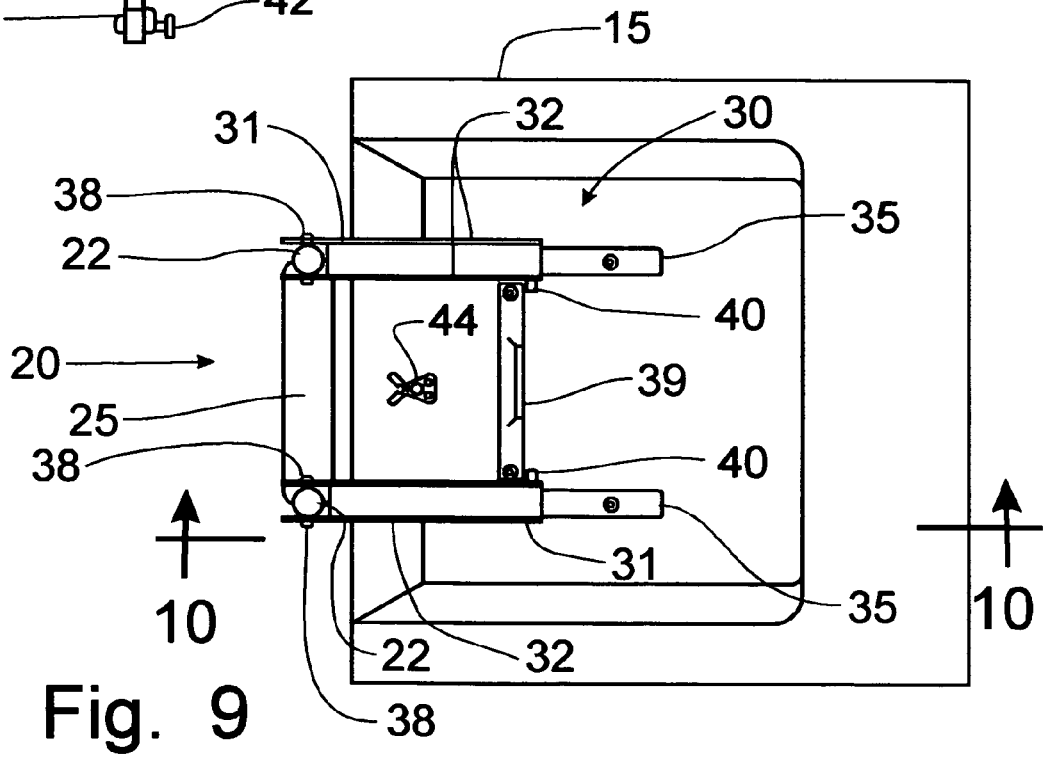
Fig. 9

RETRACTABLE TELESCOPIC BOAT LADDER

BACKGROUND OF THE INVENTION

The present invention relates generally to ladders typically mounted on the stern portion of a boat and, more particularly, to a boat ladder that is storable in a small enclosed space, yet extendible in deployment to be operable for use in exiting the water into the boat.

Telescopic boat ladders are well known in the art. The telescopic nature of the ladder enables the ladder to be stored compactly on the boat, yet be extensible to reach the water to permit swimmers to exit the water and climb into the boat. Typically, telescopic boat ladders are arranged with treads interconnecting laterally spaced rails that are progressively bigger as they are oriented from the remote distal end of the ladder. The rails are then collapsible into one another until the treads are positioned adjacent one another.

One such telescopic boat ladder is found in U.S. Pat. No. 6,021,733, issued to Alfonso Jaramillo on Feb. 8, 2000. In the Jaramillo boat ladder, the telescopic rails collapse into a compact storage unit that is pivotally mounted to the stern portion of the boat. Deployment of the Jaramillo boat ladder from the stored position is accomplished by flipping the compact ladder rearwardly about the pivotal connection thereof with the boat and then extending the rails until the ladder is deployed. The boat ladder disclosed in U.S. Pat. No. D331,219, issued on Nov. 24, 1992, to Robert Barbour, et al. employs the same general configuration in providing an extensible ladder that is pivotally mounted for swinging movement to the stern portion of a boat.

Another form of an extensible boat ladder can be seen in U.S. Pat. No. 4,733,752, issued on Mar. 29, 1988, to Robert Z. Sklar. This Sklar ladder incorporates side rails that are formed as a scissor linkage that collapses to approximately half its overall length and then is storable beneath a platform. While the scissors linkage ladder is pivotally attached to the platform, the platform could in turn be pivotally mounted to the stern portion of the boat to provide a more compact storage of the boat ladder.

A different attempt to provide a storable boat ladder is disclosed in U.S. Pat. No. 4,811,817, granted on Mar. 14, 1989, to Timothy Geary. The Geary boat ladder utilizes flexible side rails, such as ropes, to suspend ladder treads therebetween. The ladder can then be pushed into a receptacle formed in the stern portion of the boat which has a door that closes the receptacle to create a clean aesthetic appearance. The Geary rope ladder, however, does not provide stability for the person trying to exit the water and climb into the boat. Furthermore, the storage and deployment of the Geary ladder is somewhat cumbersome.

The telescopic ladders disclosed in the Jaramillo, Barbour and Sklar patents all involve a pivotal movement that swings the ladder structure from a collapsed, stored position to a deployed position. This pivotal movement requires overhead clearance and forms a structure for the boat ladder that cannot be easily actuated by someone in the water. Preferably a boat ladder will be accessible and deployable from someone floating in the water beside the boat and will provide a clean aesthetic appearance. Pivotal telescopic boat ladders as depicted in the Jaramillo and Barbour patents cannot easily be stored into a receptacle similar to the Geary patent because the pivotal boat ladder requires overhead clearance to effect the initial pivotal movement of the ladder from the stored position to the deployed position.

It would be desirable to provide a boat ladder that will be telescopic in deployment and permit a collapsed storage configuration that can be easily deployed by a person floating in the water beside the boat.

SUMMARY OF THE INVENTION

It is an object of this invention to overcome the aforementioned disadvantages of the known prior art by providing a telescopic boat ladder that does not require a swinging pivotal movement to initiate deployment from a collapsed, stored position.

It is another object of this invention to provide a telescopic boat ladder that can be stored in a receptacle formed in the stern portion of a boat and be accessible through a generally vertically disposed door covering the receptacle opening.

It is a feature of this invention that the telescopic boat ladder is mounted on a slide apparatus to initiate movement from the collapsed, stored position into the deployed position.

It is an advantage of this invention that the telescopic boat ladder can be actuated by a person floating in the water beside the boat.

It is another feature of this invention that the telescopic boat ladder cannot be seen when collapsed and stored in the closed receptacle.

It is another advantage of this invention that the telescopic boat ladder provides stability for a person exiting the water to climb onto the stern portion of the boat.

It is still another feature of this invention that the overall height of the telescopic ladder assembly permits installation into existing ladder enclosures.

It is still another advantage of this invention that boat manufacturers may not have to re-tool to facilitate the installation of a telescopic boat ladder.

It is yet another feature of this invention that the treads and side rails of the telescopic ladder fit within the confines defined by a slide mechanism for deploying the boat ladder.

It is still another feature of this invention that the slide mechanism includes a pair of opposing slide plates that are mounted for sliding movement relative to the boat while supporting the side rails of the telescopic ladder for sliding movement relative to the slide plates.

It is yet another feature of this invention that the deployment movement of the telescopic ladder and slide mechanism utilizes linear motion to effect deployment.

It is yet another advantage of this invention that the movement of the telescopic ladder incorporating the principles of the instant invention do not require any overhead clearance.

It is a further advantage of this invention that the movement of the telescopic ladder is readily adaptable to automated deployment by linear actuators.

It is still another object of this invention to provide a telescopic ladder apparatus for a boat that is durable in construction, inexpensive of manufacture, carefree of maintenance, facile in assemblage, and simple and effective in use.

These and other objects, features and advantages are accomplished according to the instant invention by providing a telescopic ladder apparatus that can be deployed from a closed receptacle on the stern portion of a boat. The telescopic ladder is formed with telescopic side rails supporting transverse treads that can collapse into a stored position in which the treads are placed adjacent one another. The side rails are mounted to a slide mechanism that is mounted in the receptacle for sliding movement relative to the boat. The slide mechanism supports the side rails for a linear sliding movement to permit the deployment of the ladder externally of the receptacle to be telescopically extended toward the water. The side rails are pivotable downwardly to position the side rails into a generally vertical deployed position from the generally horizontal stored position. The receptacle housing the telescopic ladder and slide mechanism is opened for access to the ladder through a generally vertically oriented door that provides a clean aesthetic appearance for the boat.

BRIEF DESCRIPTION OF THE DRAWINGS

The foregoing and other objects, features, and advantages of the invention will appear more fully hereinafter from a consideration of the detailed description that follows, in conjunction with the accompanying sheets of drawings. It is to be expressly understood, however, that the drawings are for illustrative purposes and are not to be construed as defining the limits of the invention.

FIG. 1 is a schematic perspective view of the stern portion of a representative boat having a telescopic ladder incorporating the principles of the instant invention mounted thereon;

FIG. 2 is an enlarged perspective view of the receptacle housing the telescopic ladder incorporating the principles of the instant invention in the stern of the boat depicted in FIG. 1;

FIG. 3 is an enlarged top plan view of the receptacle depicted in FIG. 2 with the telescopic ladder positioned in the retracted, stowed position;

FIG. 4 is a cross-sectional view of the receptacle taken along lines 4—4 of FIG. 3 to shown the telescopic ladder in a side elevational view;

FIG. 5 is a top plan view of the receptacle and telescopic ladder similar to that of FIG. 3, but depicting the telescopic ladder in a first position of deployment;

FIG. 6 is a cross-sectional view of the receptacle similar to that of FIG. 4, but depicting the telescopic ladder in a first position of deployment as shown in FIG. 5;

FIG. 7 is a top plan view of the receptacle and telescopic ladder similar to that of FIG. 5, but depicting the telescopic ladder in the second position of deployment;

FIG. 8 is a cross-sectional view of the receptacle similar to that of FIG. 6, but depicting the telescopic ladder in the second position of deployment as shown in FIG. 7;

FIG. 9 is a top plan view of the receptacle and telescopic ladder similar to that of FIG. 7, but depicting the telescopic ladder in full deployment;

FIG. 10 is a cross-sectional view of the receptacle similar to that of FIG. 8, but depicting the telescopic ladder in full deployment as shown in FIG. 9; and FIG. 11 is an enlarged cross-sectional detail view of a slide plate assembly taken along lines 11—11 of FIG. 3, the side rail being removed for purposes of clarity.

DETAILED DESCRIPTION OF THE PREFERRED EMBODIMENT

Referring to the drawings, a telescopic boat ladder incorporating the principles of the instant invention can best be seen. The ladder 20 is mounted preferably on the stern portion 12 of the boat 10, representatively depicted in FIG. 1. The ladder 20 is configured to be positionable in a compact collapsed position within the confines of the receptacle 15. A door 17 closes the generally vertical opening into the receptacle 15 to match with the adjacent surfaces of the stern portion 12 of the boat 10 to provide a clean aesthetic appearance in which the ladder 20 cannot be seen when the ladder 20 is in the stored position and the door 17 is closed.

The telescopic ladder 20 includes side rails 22 and transverse treads 25 that incorporate a generally conventional design in that the side rails 22 have an increasingly smaller diameter and are telescopically received within the side rail segment immediately above each respective side rail segment. A transverse tread 25 spans corresponding side rail segments and are positioned and configured to telescopically collapse into a position in which the respective treads 25 are positioned adjacent one another with the corresponding side rail segments received in a telescopic manner, as is depicted in FIGS. 3 and 4.

The side rails 22 of the ladder 20 are mounted to a slide mechanism 30 including a pair of opposing generally vertically oriented slide plate assemblies 31 that are slidably mounted on the boat by corresponding slide rails 35 to permit a linear motion for the slide plate assemblies 31. Each slide plate assembly 31 is formed with a pair of parallel slide plates 32 between which the corresponding side rail 22 of the ladder 20 is mounted for movement as is described in greater detail below. The slide plates 32 are interconnected with a bottom pan member 34 to provide stability for the upright slide plates 32, as is best seen in FIG. 11.

Each slide plate 32 is formed with a slot 33 in which is positioned a pivot assembly 37 supporting the opposing side rails 22 for pivotal motion relative to the slide plate assembly. The pivot assemblies 37 are preferably formed by opposing pins 38 extending out of the side rails 22 to be received within the opposing slots 33. Accordingly, the pins 38 are movable within the limits defined by the slots 33 and support the respective side rail 22 for pivotal movement for deployment of the ladder 20, as will be described in greater detail below. Each slide plate assembly 31 is supported on a corresponding slide rail 35 for movement relative thereto. Each slide rail 35 is fixed to the boat structure within the receptacle 15.

Preferably, the slide plate assembly 31 is formed with a pair of opposing slide plate members 32 that are curved at the lower portion thereof to fit beneath and capture the slide rail 35. The bottom pan member 34 is preferably formed as a plate having several tabs 36 projecting outwardly therefrom to engage appropriate openings formed in the respective slide plate members 32 and are welded thereto to form an integral slide plate assembly 31 that encaptures the slide rail 35 and slides thereon. Bearings, or other suitable friction reducing material, (not shown) are disposed between the slide plate assembly 31 and the slide rail 35 to facilitate the sliding movement of the slide plate assembly 31 on the slide rail 35.

The ladder 20 is formed from ladder sections 26–28 that are telescopically received in one another in a known manner to permit the extension and compaction of the ladder 20 as depicted in the drawings. The first ladder section 26 is supported from the slide plate assemblies 31 by the pivot assemblies 37, while the second ladder section 27 includes side rail segments 23*b* that are sized to be received within the side rail segments 23*a* in the first ladder section 26 so as to be telescopic therefrom. Similarly, the third ladder section 28 has side rail segments 23*c* that are telescopically received within the side rail segments 23*b* of the second ladder section 27. Each ladder section 26–28 carries a ladder tread 25 between the side rail segments 23 thereof in a manner to permit the compact positioning of the ladder 20 in the orientation depicted in FIGS. 3 and 4 with one tread 25 positioned adjacent the tread of the adjacent ladder section.

A stop member 39 is mounted in the receptacle 15 in a manner to engage the tread 25 on the first ladder section 26 when the ladder 20 is being placed into the compact stowed position within the receptacle 15, as is depicted in FIG. 3, so that the ladder 20 and slide assemblies 31 to not extend too far into the receptacle 15 to impact the back wall of the receptacle 15 and cause damage thereto. Similarly, when the ladder 20 is being deployed, as will be described in greater detail below, stop pins 40, positioned on the interior of the distal end of the innermost slide plates 32, engage the stop member 39 to prevent the ladder 20 and the attached slide assemblies 31 from becoming disengaged from the slide rails 35 and, thus, falling into the water behind the boat 10. Accordingly, the stop member is positioned and the dimensions of the slide assemblies 31 and of the first ladder section 26 are such that the pivot assemblies 37 are located rearwardly of the stern of the boat 10 when the ladder 20 is being deployed, as will be described in greater detail below.

As best seen in FIGS. 5–8, the ladder 20 can be provided with a latch mechanism in the form of a latch pin 42 formed as part of the tread 25 of the third ladder segment 28 and positioned to engage a latch keeper 44 connected to the stern of the boat 10 within the receptacle 15. Thus, when the ladder 20 is completely retracted and stowed behind the door 17 of the receptacle 15, the latch pin 42 is mated with the latch keeper 44 to retain the ladder 20 in the stowed position. Preferably, the latch keeper 44 is a plastic member that yields with engagement of the latch pin 42 and yields or opens to release the latch pin 42 with the application of a force to move the ladder 20 out of the stowed position. In the alternative, the latch keeper 44 could be a spring-loaded apparatus that properly retains engagement of the latch pin 42 when it is desired to retain the ladder 20 in the stowed position.

Boat manufacturers can have a prescribed enclosure in which to place a retractable boat ladder without requiring a re-tooling of the manufacturing process. Such an enclosure can be restrictive as to the height and length limitations of the stored boat ladder. Accordingly, the boat ladder will preferably be formed in as small of a package as possible when placed into the collapsed, stored position. For boat ladders, a critical dimension is the depth of the treads, which when the boat ladder 20 is placed into a generally horizontal stowed position becomes a vertical height limitation for the stowed ladder structure.

In operation, the telescopic ladder 20, beginning from the stowed position depicted in FIGS. 3 and 4, is deployed by pulling the ladder 20 outwardly through an opened receptacle 15, disengaging the latch pin 42 from the latch keeper 44. If the receptacle 15 has a door 17, the door would first be moved to an opened position as shown in phantom in FIG. 2. The displacement of the ladder 20 through the opened receptacle 15 will accomplish two movements substantially simultaneously, although depending on friction and tolerances of components one sliding movement may occur before the other sliding movement. As is depicted in FIGS. 5 and 6, the slide plate assemblies 31 will slide on the fixed slide rails 35 to move the ladder 20 outwardly through the opened receptacle 15. The sliding movement of the slide plate assemblies 31 will cease when the stop pins 40 engage the stop member 39. Additionally, as is depicted in FIGS. 7 and 8, the pivot assemblies 37 will move relative to the slide plate assemblies 31 with the pins 38 riding within the slots 33 in the slide plates 32. The movement of the pivot assemblies 37 relative to the slide plate assemblies 31 will cease when the pins 38 reach the ends of the slots 33.

Between the two sliding movements noted above, the pivot assemblies 37 will be located rearwardly of the stern of the boat 10, as is seen in FIGS. 7 and 8, so that the telescoping ladder 20 can be fully deployed, as will be described in greater detail below. The double sliding movement to initiate the deployment of the ladder 20 from the receptacle 15 allows the ladder 20 to be extended outwardly from the receptacle 15 sufficiently to permit further deployment without requiring overhead clearance as is known with conventional telescoping ladders. As a result, the receptacle 15 can have a closed upper surface, one that is fixed relative to the structure of the boat 10, as only the door 17 needs to provide an opening for the deployment of the ladder 20. Furthermore, the deployment of the ladder 20 can then be initiated by a person positioned in the water, as only the door 17 needs to be opened to deploy the ladder 20. In conventional pivoting ladders, such as disclosed in U.S. Pat. No. 6,021,733, issued to Alfonso Jaramillo on Feb. 8, 2000, the area immediately above the ladder needs to be cleared of obstructions before the ladder can be deployed. If the Jaramillo ladder were mounted in a receptacle 15, the top surface of the receptacle would have to be opened in addition to the rear-facing surface to permit the ladder to move. Accordingly, such pivoting ladders cannot be easily deployed by a person in the water.

Once the ladder 20 has been moved to the position where the pivot assemblies 37 are clear of the rearward surface of the stern of the boat 10, the side rails 22 can be pivoted relative to the slide plates 32 to position the ladder 20 generally parallel with the rear-facing surface of the stern of the boat 10 to direct the ladder 20 downwardly toward the water. Grasping the lowermost tread 25 on the end ladder section 28 will result in the ladder sections 26–28 telescopically extending to a position generally depicted in FIGS. 9 and 10. The person in the water can then gain access into the boat 10 by climbing up the ladder 20.

Returning the ladder 20 to the stowed position shown in FIGS. 3 and 4 is accomplished simply by reversing the procedure described above for deployment. The telescopic ladder sections 26–28 are collapsed until the treads 25 abut one another. Then, the side rails 22 of the ladder 20 can be pivoted upwardly about the pivot assemblies 37 until the ladder 20 is generally aligned with the receptacle 15. The ladder 20 can then be slid into the receptacle 15 with the pivot assemblies 37 moving along the slots 33 in the slide plates 32 and the slide plate assemblies 31 moving along the corresponding slide rails 35. This sliding movement will cease when the pins 38 reach the end of the slots 33 and, respectively, when the tread 25 on the first ladder section 26 engages the stop member 39 and the latch pin 42 is engaged with the latch keeper 44. The door 17 can then be moved to close the receptacle 15, causing the ladder 20 to be hidden from sight within the clean lines of the boat structure 10.

The invention of this application has been described above both generically and with regard to specific embodiments. Although the invention has been set forth in what is believed to be the preferred embodiments, a wide variety of alternatives known to those of skill in the art can be selected within the generic disclosure. The invention is not otherwise limited, except for the recitation of the claims set forth below.

What is claimed is:

1. A telescopic ladder for a boat comprising:

a plurality of ladder sections telescopically interconnected to permit movement thereof between a compact storage position and an extended deployed position; and a slide mechanism operable to support said ladder sections on said boat, said slide mechanism permitting a linear movement of said ladder sections in a first direction and a pivotal movement of said ladder sections to position said ladder sections in an orientation at an angle to said first direction, each said slide mechanism including:

a pair of laterally spaced T-shaped slide rails configured to be affixed to said boat; and a pair of slide plate assemblies mounted on corresponding said slide rails for linear movement of said slide plate assemblies relative to said slide rails, each said slide plate assembly including a pair of generally vertical slide plates, each said slide plate being formed with a slot therein extending generally horizontally, one of said ladder sections being pivotally connected to said slide plate assemblies by corresponding pivot assemblies engaged with the slots in said vertical slide plates to permit said pivotal movement of said ladder sections relative to said slide plate assemblies.

2. The telescopic ladder of claim 1 wherein each said ladder section includes a pair of laterally spaced side rails with at least one tread disposed between said side rails, said pivot assemblies include a pair of slide pins projecting in opposing directions from each said side rail on said one ladder section with said slide pins being received in respective slots in said slide plates, said side rails being positioned between the corresponding said slide plates.

3. The telescopic ladder of claim 2 further comprising a stop member operable to be affixed to said boat to engage said slide plate assemblies to limit the movement thereof in said first direction.

4. The telescopic ladder of claim 3 wherein said slide plate assemblies include a stop pin affixed to one of said slide plates for engagement with said stop member.

5. The telescopic ladder of claim 4 wherein said stop member is positioned to engage the tread of said one ladder section when said ladder is placed into a stowed position to limit the movement of said slide plate assemblies relative to said slide rails in said first direction.

6. In a telescopic ladder for use on a boat, said ladder being movable between a compact stowed position and an extended deployed position, said telescopic ladder including a plurality of ladder sections interconnected in a telescopic manner to extend to a full length of said ladder when placed into said deployed position, the improvement comprising:

a slide mechanism operable to support said ladder sections on said boat, said slide mechanism permitting a two stage linear movement of said ladder sections in a first direction, said slide mechanism including:

a pair of T-shaped slide rails configured to be affixed to said boat and having an enlarged head; and a pair of slide plate assemblies mounted on corresponding said slide rails for linear movement in said first direction, each said slide plate assembly including a pair of generally vertical slide plates engaged with the corresponding said enlarged head such that each said slide plate assembly is movable on the corresponding said slide rail in said first direction; and one of said ladder sections being pivotally connected to said slide mechanism to permit a pivotal movement of said ladder sections to position said ladder sections in an orientation at an angle to said first direction to reach said deployed position, each slide plate being is formed with a slot therein extending generally horizontally, said one of said ladder sections having slide pins extending outwardly therefrom in opposing directions and engaged with the slots in opposing slide plates for pivotally connecting said one ladder section to said slide plate assemblies, said two stage linear movement being accomplished through the movement of said slide plate assemblies on said slide rails and by the movement of said one ladder section along said slot relative to said slide assemblies.

7. The telescopic ladder of claim 6 wherein further comprising a stop member operable to be affixed to said boat to engage said slide plate assemblies to limit the movement thereof in said first direction, said slide plate assemblies including a stop pin affixed to one of said slide plates for engagement with said stop member to limit movement of said slide plate assemblies in said first direction, said one ladder section being engagable with said stop member to limit movement of said ladder sections in a second direction opposite said first direction.

8. The telescopic ladder of claim 7 wherein each said ladder section includes a pair of laterally spaced side rails with at least one tread disposed between said side rails, the side rails of said one section being sized to telescopically receive the side rails of the adjacent said ladder section, said tread on said one ladder section engaging said stop member to limit the movement thereof in said second direction.

9. A telescopic ladder for a boat comprising:

a plurality of ladder sections telescopically interconnected to permit movement thereof between a compact storage position and an extended deployed position, each said ladder section including a pair of laterally spaced side rails with at least one tread disposed between said side rails; and a slide mechanism operable to support said ladder sections on said boat, said slide mechanism permitting a linear movement of said ladder sections in a first direction and a pivotal movement of said ladder sections to position said ladder sections in an orientation at an angle to said first direction, said slide mechanism including:

a pair of laterally spaced T-shaped slide rails fixed to said boat; and a pair of slide plate assemblies mounted on corresponding said slide rails for linear movement of said slide plate assemblies relative to said slide rails; each said slide plate assembly including a pair of laterally spaced, generally vertical slide plates formed with a slot therein extending generally horizontally, one of said ladder sections being pivotally connected to said slide plate assemblies by corresponding pivot assemblies engaged with the slot permitting pivotal movement of said ladder sections relative to said slide plate assemblies; and a stop member operably positionable on said boat for engagement of said slide plate assemblies to limit the movement thereof in said first direction, said stop member being operable to engage the tread of said one ladder section when said ladder is placed into a stowed position to limit the movement of said slide plate assemblies relative to said slide rails in said first direction.

10. The telescopic ladder of claim 9 wherein each said pivot assembly includes a pair of slide pins projecting in opposing directions from each said side rail on said one ladder section with said slide pins being received in respective slots in said slide plates, said side rails being positioned between the corresponding said slide plates.

11. The telescopic ladder of claim 10 wherein said slide plate assemblies include a stop pin affixed to one of said slide plates for engagement with said stop member.

* * * * *